United States Patent [19]

Jennie

[11] Patent Number: 4,597,212

[45] Date of Patent: Jul. 1, 1986

[54] SAFETY DEVICE FOR GUNS

[75] Inventor: Fred Jennie, Corona del Mar, Calif.

[73] Assignee: Weatherby, Inc., South Gate, Calif.

[21] Appl. No.: 519,077

[22] Filed: Aug. 1, 1983

[51] Int. Cl.[4] ..... F41C 17/02

[52] U.S. Cl. ..... 42/70 E; 42/41; 42/42 R; 42/44

[58] Field of Search ..... 42/70 E, 41, 42 R, 44, 42/45

[56] References Cited

U.S. PATENT DOCUMENTS 741,506 10/1903 Kirmse ..... 42/70 E
1,707,538 4/1929 Page ..... 42/70 E
2,465,432 3/1949 Curci ..... 42/70 E
3,130,513 4/1964 Knode, Jr. ..... 42/70 E
4,403,436 9/1983 Jennie ..... 42/42 R

*Primary Examiner*—Charles T. Jordan
*Assistant Examiner*—Ted L. Parr
*Attorney, Agent, or Firm*—Evanns & Walsh

[57] ABSTRACT

A safety mechanism for guns having an openable breech. Guns of this type have a manual lever for operating the breech locking mechanism. The invention provides a linkage between this lever and a trigger block member which prevents trigger actuation. As a result, the gun cannot be fired unless the breech is in a fully closed and locked position.

8 Claims, 9 Drawing Figures

SAFETY DEVICE FOR GUNS

BACKGROUND OF THE INVENTION

1. Field of the Invention

The field of the invention is that of safety mechanisms for firearms. The invention is particularly adaptable in shotguns having a breech which can be opened and which can be closed and locked in the closed position. The invention involves a safety device or an additional safety mechanism constructed to prevent firing of the gun unless it is assured that the breech is in the closed and locked position.

2. Description of the Prior Art

Safety mechanisms for guns are, of course, well-known in the art. In guns of the type referred to in the foregoing, typically there is a safety button rearwardly of a lever which locks and unlocks the breech. Typically, the mechanism as provided relates the safety button to the trigger so that when the button is in the safety position, the trigger cannot be pulled for firing the gun.

A need has developed for a further safety feature which is a safety mechanism which will insure that the gun cannot be fired, that is, that the trigger cannot be pulled unless it is assured that the breech is closed and locked. As presently known, safety mechanisms do not provide for this contingency, that is, it has been possible to fire the gun with the safety button in the firing position, even though the breech was not closed and locked.

An example of the gun of the type referred to in the foregoing is shown in U.S. Pat. No. 3,537,203, and this mechanism embodies a safety of the type which cooperates with the trigger to prevent pulling of the trigger when the safety is in the safe position.

The herein invention in a preferred exemplary form, which is described in detail hereinafter provides a novel and unique safety mechanism which can be set into a position which assures that the gun cannot be fired unless there is assurance that the breech is closed and locked.

SUMMARY OF THE INVENTION

In a preferred form of the invention, as described in detail hereinafter, it is constructed so as to be a part of, or an addition to, a safety device, as previously known.

In a typical form of safety device as previously known, the safety button which is on top of the receiver is movable forwardly and rearwardly, typically the rearward position being the safety position. The safety button moves a holding member or trigger block which is inside the receiver and which is movable from the firing position to a position wherein it has a part positioned over the trigger mechanism so as to block movement of the trigger, that is, to prevent the rotating movement of the trigger necessary for firing so that safety is assured since the trigger cannot be pulled.

The herein invention in the preferred form provides for additional safety which, in the form of the invention disclosed herein, is an additional position of the trigger block. This is a position of the trigger block in which otherwise, or previously, was a position in which the trigger could be pulled for firing. The improved mechanism of the invention provides for blocking or holding of trigger movement in this position as well, unless and until there is assurance that the breech is closed and locked.

The movable lever which locks and unlocks the breech is over the top of the receiver. Normally, its movement rotates a stem which operates a mechanism to lock and unlock the breech. In the improvement of the invention, a movable link is provided which is actuatable by the said stem and which is connected to the aforementioned holder or trigger block which is movable by the safety button. An additional member is provided which is in the form of a pin that is engageable with a trigger extension and which extends through the holder or trigger block and which blocks the trigger from being actuated if the breech is not closed and locked, the pin cooperating with a recess or a hole so that unless the breech locking lever is in a position wherein the breech is closed and locked, the said stem is in a position blocking the trigger from being pulled. Thus, the additional safety feature is provided that the gun remains on safety, that is, a position in which it cannot be fired, unless there is assurance that the breech is closed and locked, resulting from the breech control lever having been returned to the locked position.

In light of the foregoing, the primary object of the invention is to provide a safety device for guns of the type having a breech mechanism which can be opened and closed, which provides that the trigger mechanism is on safety unless and until the breech has been closed and locked.

A further object is to provide a safety feature as in the foregoing in a mechanism which embodies a conventional safety mechanism whereby in a safety position of the safety button, the gun cannot be fired.

A further object is to realize a safety feature as in the foregoing by way of a linkage connected between the breech locking lever and the holder or trigger block whereby the trigger is still blocked from movement, that is, it is still on safety until the breech operating lever has returned to a position assuring that the breech is closed and locked.

A further object is to realize the additional safety feature by way of a mechanism including a pin positioned in a hole in the safety holder or trigger block which prevents firing movement of the trigger unless the holder member has been moved to a position wherein the pin is opposite a recess allowing movement of the pin sufficiently to allow firing movement of the trigger. That is, the trigger block has a firing position, and in any other position it is on safety preventing firing.

Further objects and additional advantages of the invention will become apparent from the following detailed description and annexed drawings.

DESCRIPTION OF THE PREFERRED EMBODIMENT AND BEST MODE OF PRACTICE OF THE INVENTION

The trigger mechanism of the herein invention as shown is like that of the prior application, now U.S. Pat. No. 4,403,436, which is hereby incorporated herein by reference. The trigger mechanism, as shown, is exemplary of trigger mechanisms that the invention might be associated with. Reference is also made to U.S. Pat. No. 3,537,203, which is hereby incorporated herein by reference.

Figure 1:
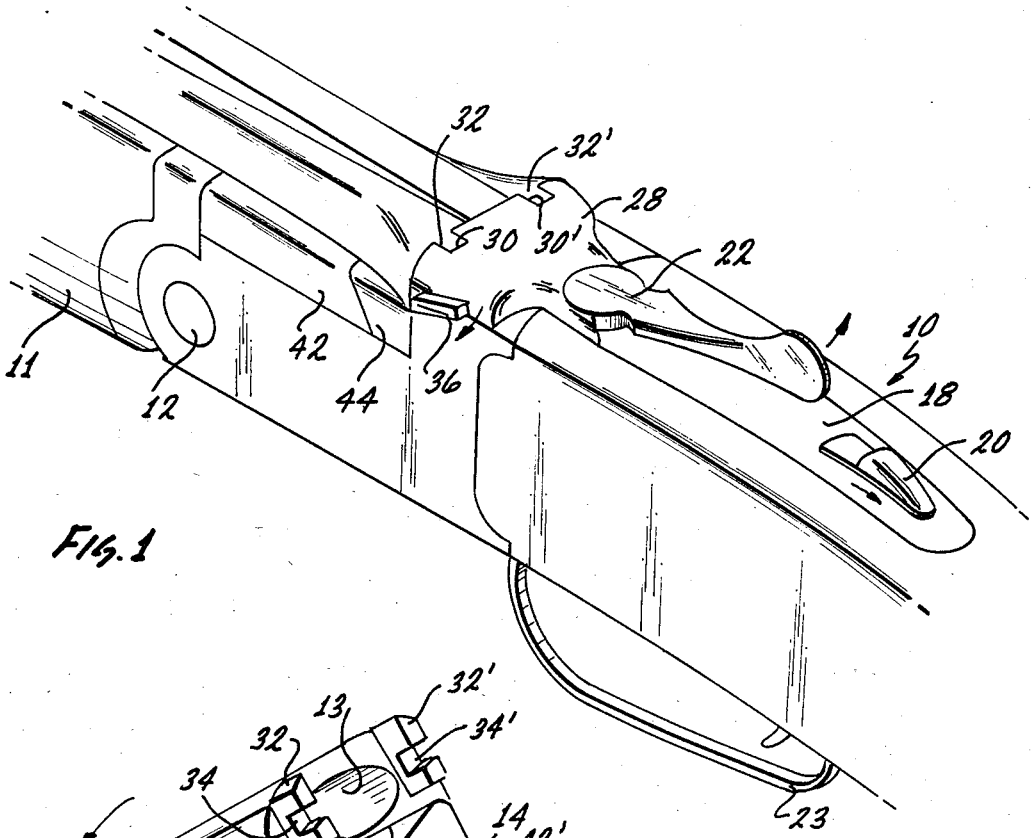
FIG. 1 is a partial pictorial view of the receiver part of a gun, having a breech mechanism in which the invention may be embodied.
Figure 2:
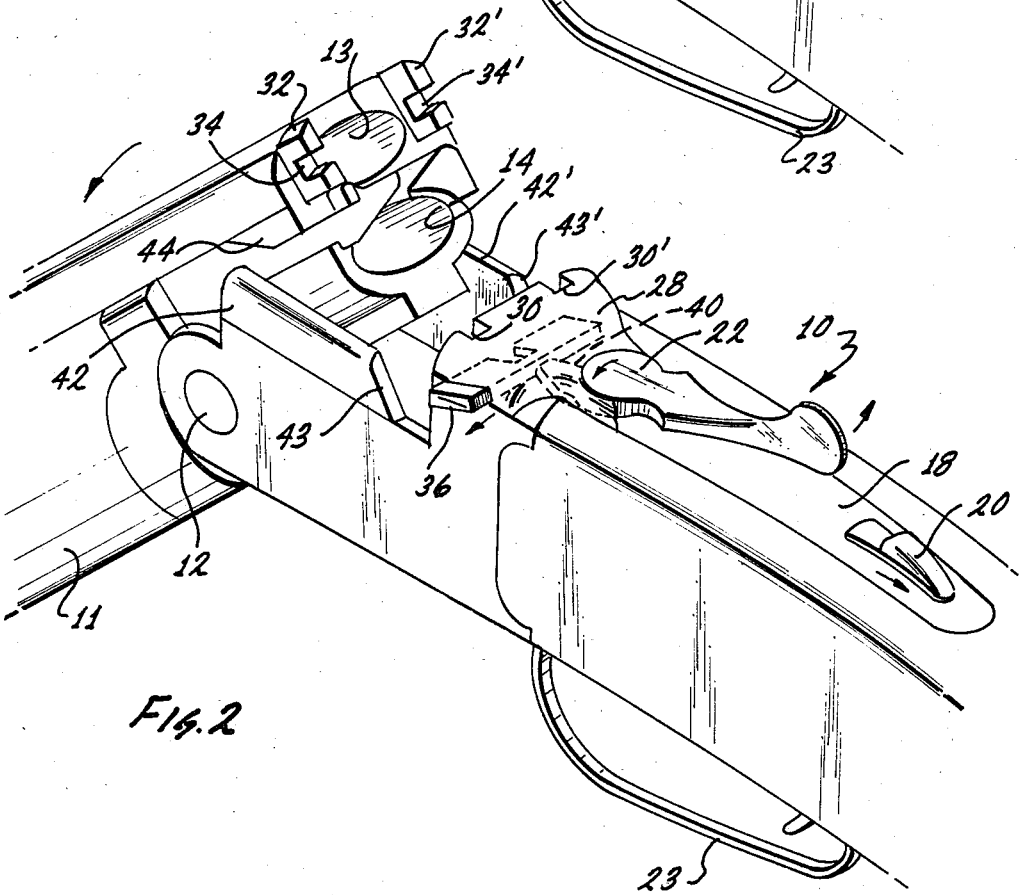
FIG. 2 is a pictorial view of the gun of FIG. 1, showing the breech in the open position.

FIGS. 1 and 2 illustrate the receiver portion of a type of gun in which the invention may be embodied. The gun, as shown, is an over-and-under type of shotgun, having a breech which can be opened to a position as shown in FIG. 2. The rear part of the gun including the receiver is designated at 10, which has a pivotal attachment to the barrel part 11 by way of a pivot, as designated at 12. There are two barrels, 13 and 14, one over the other, as shown.

Numeral 18 designates a panel at the top of the receiver, which will be referred to again more in detail presently. Carried on this panel is a safety button 20 which in itself is conventional in the art. The panel 18 also carries lever 22 which locks and unlocks the breech mechanism. Numeral 23 designates a trigger guard.

Forward of the lever 22, the frame of the receiver has a configuration, as designated at 28, in the front face of which are vertical slots 30 and 30'. At the rear end of the upper barrel are extending lugs 32 and 32' which have intermediate slots or openings 34 and 34'. FIG. 2 shows the breech open, and FIG. 1 shows the breech closed, illustrating the cooperation between the lugs 32 and 32' and the slots 30 and 30'. Numeral 36 designates a locking bar member that can slide transversely in a slot in the part 28 previously described. The lever 22 has a forwardly extending blade part 40 which engages the underside of the bar 36 for moving it when the lever 22 is moved. In the closed position of the breech, when the lever 22 is moved into its normal mid position, the bar 36 is moved to the right so that it engages in the slots or openings 34 and 34' in the barrel section so that the breech is locked. FIGS. 3–6 also illustrate the relationship between the barrel part of the gun and the receiver at the breech.

At the sides of the receiver part are upstanding members 42 and 42', forwardly of cutouts as shown at 43 and 43' which come into a position adjacent portions of the barrel part, as designated at 44 on the left side of the gun, as seen in FIGS. 1 and 2.

The safety mechanism of the invention is illustrated in FIGS. 3–9. An exemplary form of a trigger mechanism is illustrated in FIGS. 3–6 which is like that of the prior application, now U.S. Pat. No. 4,403,436.

A conventional stock may be attached to the receiver portion of the gun by way of the parts 50 and 51.

The trigger as a whole is designated by the numeral 52, the trigger being rotatable around a pivot pin 53. The trigger includes a trigger extension 54 having a flat top 55. The extension 54 fits into a slot in the upper part of the trigger and is secured thereto as shown. The exemplary form of the trigger mechanism as shown will be described in further detail presently.

The safety button 20 is movable forwardly and rearwardly. Extending from it is a stem 60 that moves in an opening 61 in the top panel 18. When the button 20 and stem 60 are in the forward position, the trigger mechanism is in the position for firing. This is the position of the parts shown in FIGS. 3 and 4. When the button is in its most rearward position, it is in the normal safety position, as will be described.

The stem 60 is connected to a safety trigger block or holder 62 which has a configuration as may be seen in FIGS. 3–6 and 9. As may be seen in FIG. 9, the rear end of holder 36 is bifurcated, providing legs 63 and 63'. Stem 60 is pivotally attached between these legs by way of a pin 64. Numeral 66 designates a leaf spring attached to the bottom of panel 18 by a screw 67. It has a crimped end part 70 which cooperates with a pin 72 extending from the trigger block 62, forming a detent establishing forward and rearward positions of the block 62.

The trigger block or holder 62 at its forward end has a downwardly extending projecting part 71. It has a hole or bore extending through it, as designated at 73, which receives a pin 74 having a head 75, as will be described more in detail presently. See FIG. 9. The pin 74 has a rounded nose, as shown at 76.

In the normal safety position, the button 20 is moved rearwardly, the stem 60 moving in the opening 61 so that the extension 71 of block 62 is brought over the top of the extension 54 of the trigger so that the trigger cannot be rotated in a counterclockwise direction so that the gun cannot be fired. This construction in itself is conventional.

Figure 3:
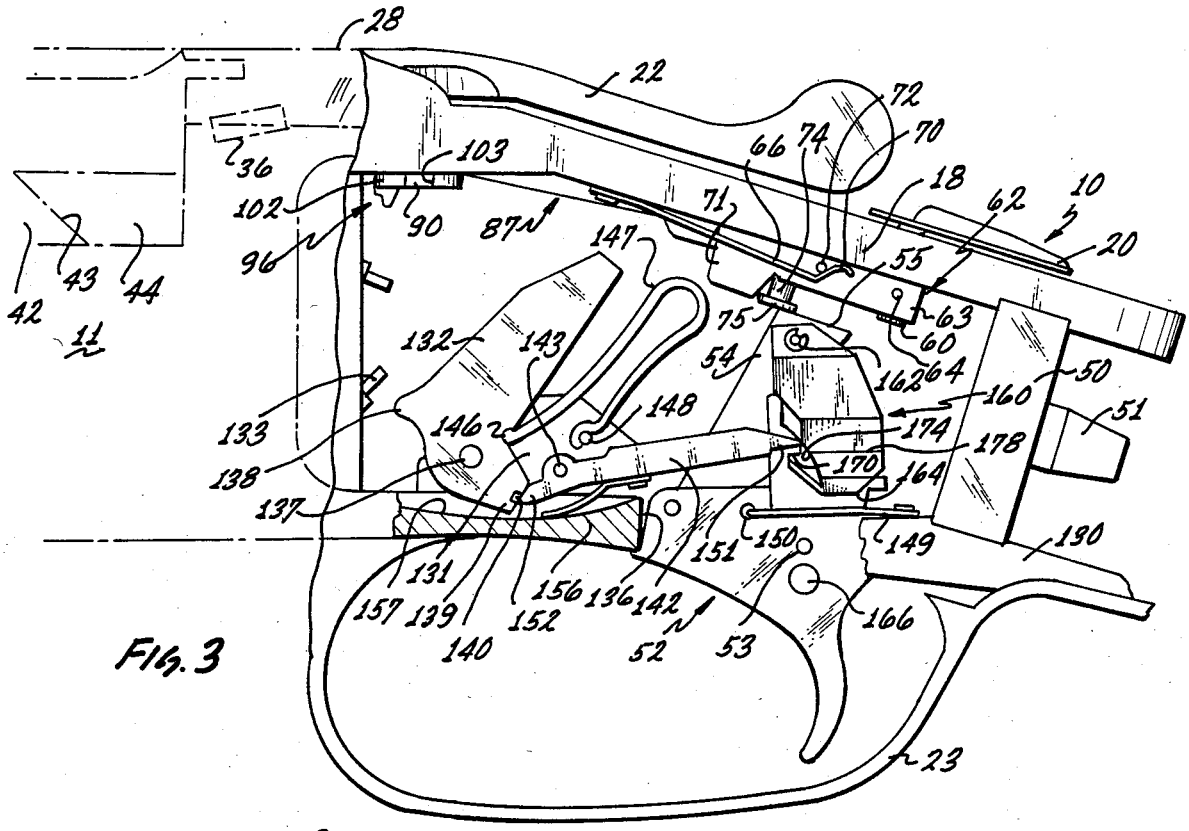
FIG. 3 is an elevational view of the gun portion of FIGS. 1 and 2, illustrating partly schematically the trigger mechanism and the safety feature of the invention with the parts in the firing position before pulling the trigger.
Figure 4:
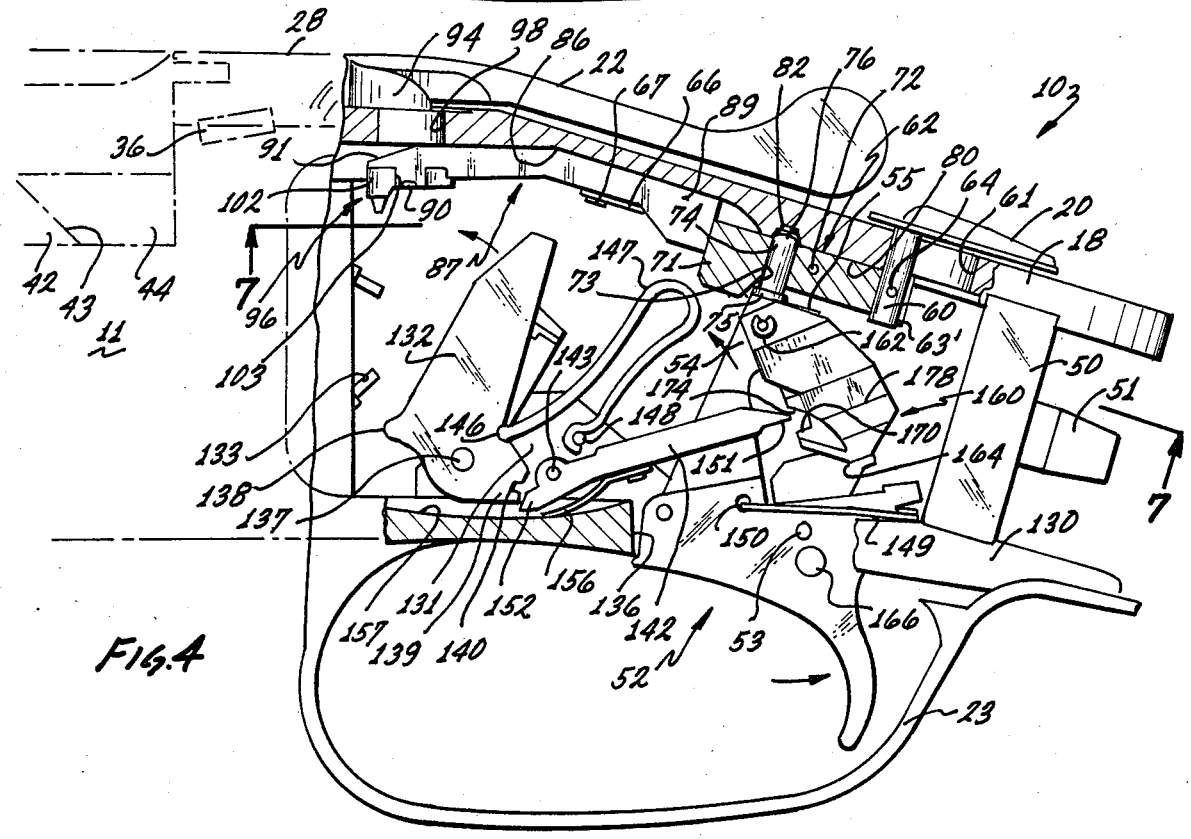
FIG. 4 is a view similar to that of FIG. 3, showing the parts just after pulling the trigger.
Figure 5:
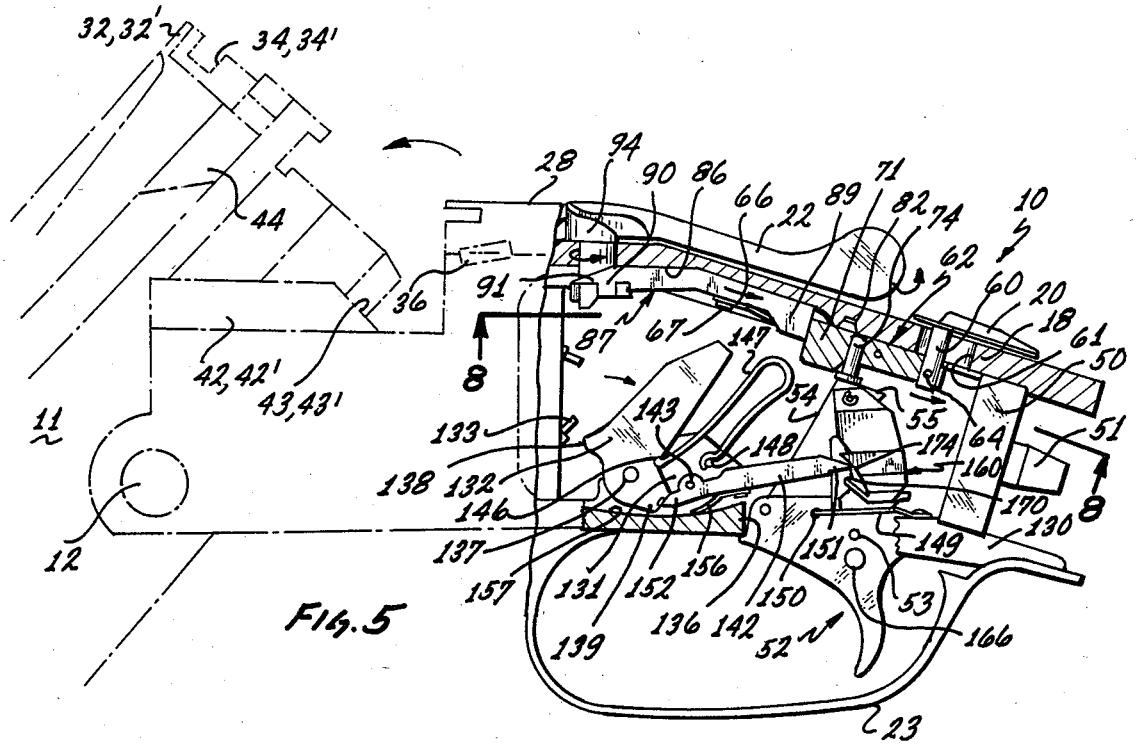
FIG. 5 is a view similar to that of FIGS. 3 and 4, but showing the breech in the open position and the safety mechanism in the position to prevent firing.
Figure 6:
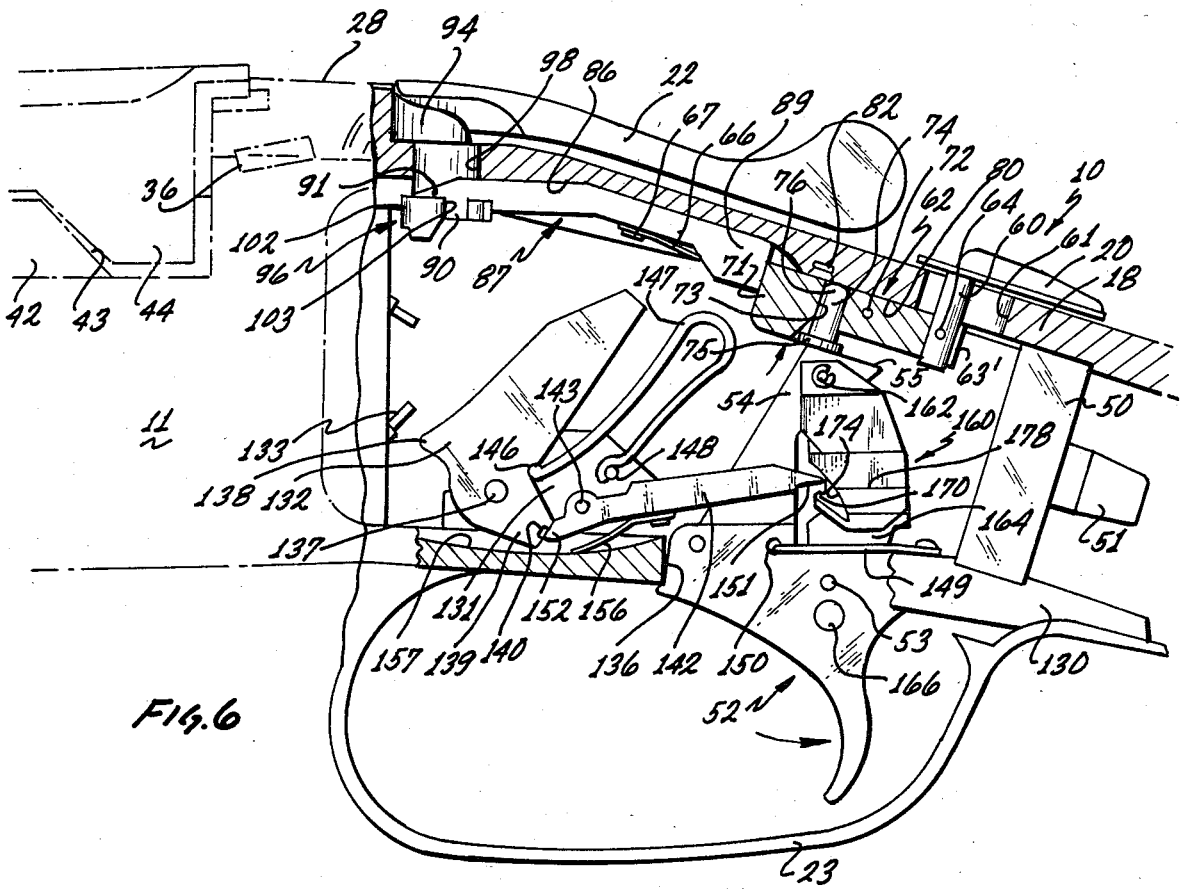
FIG. 6 is a view similar to that of FIG. 5, with the breech in a position not quite closed with the safety mechanism in the position to prevent firing.

The mechanism of the invention provides for displacement of the holder or block member 62 out of the position in which normally the gun can be fired; it cannot be fired until the lever 22 has been returned to the closed and locked position of the breech. FIGS. 3 and 4 show the parts in the closed and locked position of the breech, and FIGS. 5 and 6 illustrate the parts wherein, as may be seen, button 20 and the stem 60 are displaced a slight amount rearwardly with respect to the opening 61.

The pin 74 floats in the hole or bore 73, its head 75 resting on top of the trigger extension part 54, as may be seen in FIGS. 3–6.

Figure 9:
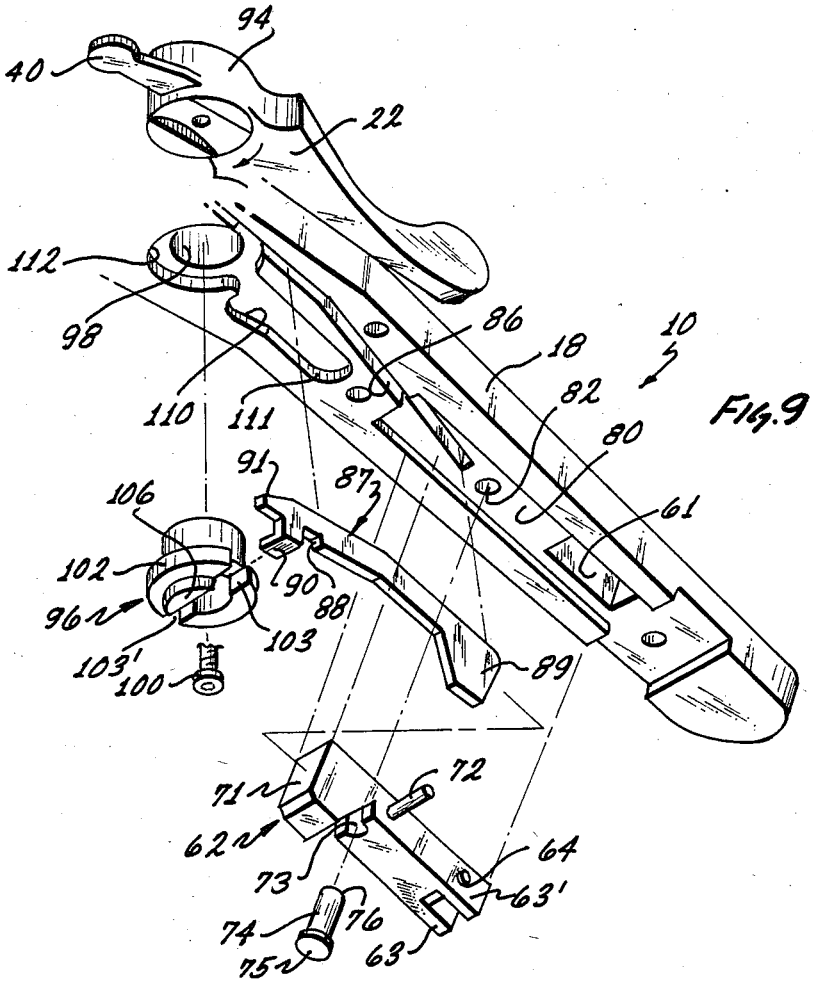
FIG. 9 is an exploded isometric view of the parts of the safety mechanism.

The block or holder member 62 can slide in a slot or groove 80 in the underside of the panel 18, as may be seen in FIG. 9. Formed in the base of slot or recess 80 is a tapered depression 82 which can receive the rounded end 76 of the pin 74, as will be described. This position of the pin 74 is illustrated in FIG. 4, this being the only position in which the trigger can be pulled for firing, as will be explained.

Formed in the lower surface of the panel 18 is an elongated slot 86 in which is positioned a link member 87. The link member has an enlargement or extending part 89 at its rear end which can abut the end part 72 of the block member 62. It is shaped to conform to the slot 86.

At the forward end of the link 87 is a cutout and a tab 90 extending at a right angle as well as an extending point 91.

The lever 22 has a boss 94 at its end from which the blade member 40 extends, as previously described, which operates the mechanism which releases and locks the breech in the closed position, this mechanism having been described in connection with FIGS. 1 and 2.

Numeral 96 designates a cylindrical part or barrel member which is journalled in a bore 98 in the panel 18, as may be seen in FIGS. 5, 6 and 9. The upper end of the member 96 extends through the bore 98 and is secured to the boss 94 of lever 22 by means of a screw 100.

The lower end of the member 96 has an annular flange or rib 102 around it, having diametrically opposed openings or slots 103 and 103'. On one side of the end of the rib 102 is an extension 106, and the tab 90 fits into the opening or slot 103 in the barrel part 96.

Formed in the bottom surface of the panel 18 is a recess 110 having a shape, as shown in FIG. 9. The recess has an elongated part 111 and a circular end part 112. Received in the recess is a spring 116 of general U-shape or closepin type having a shorter leg 117 and a longer leg 118, having an end which extends into an opening in the side of the upper part of the barrel member 96 so as to bias that member in a counterclockwise direction, as illustrated in FIG. 5, so that when the breech is fully closed, the spring will rotate the lever 22 back into its mid position, bringing the parts back into a firing position, as illustrated in FIGS. 3 and 4 and as will be explained further presently.

Figure 8:
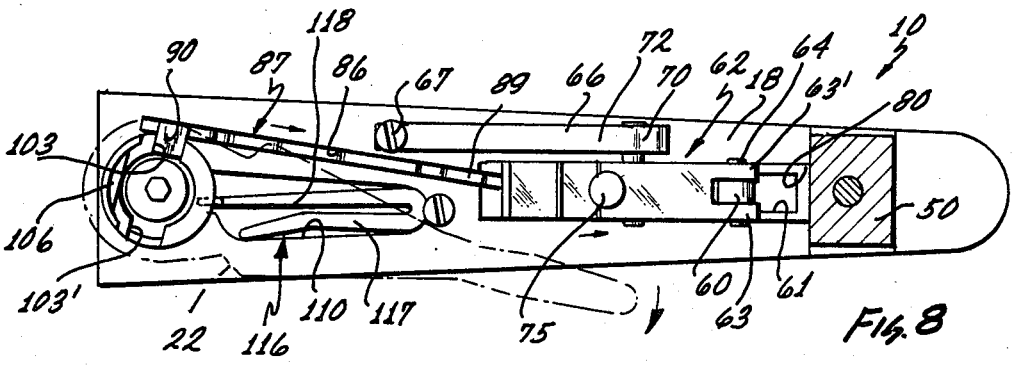
FIG. 8 is a view taken along the line 8—8 of FIG. 5 wherein the trigger block has been moved out of the firing position.

When the lever 22 is moved out of its intermediate position for unlocking the breech, the barrel part 96 is rotated in a counterclockwise direction, as illustrated in FIG. 5. This moves link 87 to the right, as shown in FIGS. 5 and 8, which in turn moves the trigger block 62 into a position, as may be seen in FIGS. 5 and 6, wherein the gun may not be fired. It is to be seen that in the position of the parts as shown in FIGS. 3 and 4, the nose 76 of the pin 74 is received in the depression 82. This is the position for normal firing and is the only position in which the trigger can be pulled. In this position, the trigger can be pulled, as illustrated in FIG. 4, with the top 55 of the trigger extension 54 sliding relative to the head 75 of the pin 74. In this position, the breech is closed and locked. In the positions of the parts, as shown in FIGS. 5 and 6, and as described, the trigger block 62 is moved to the right a small amount, and the nose 76 of the pin 74 is moved out of the recess 82. This moves the pin 74 a small amount in its bore, which might be 1/16th of an inch, bringing its head 75 into a position relative to the upper end 55 of the trigger extension 54 so that the trigger is now held and cannot be pulled for firing. FIGS. 3 and 4 illustrate the only position of the parts in which the trigger can be pulled for firing. In this position, the lever 22 is moved back to its intermediate position in which the breech is closed and locked.

As previously pointed out, an exemplary form of trigger mechanism is shown. The hammers, sears, and connector block are like the corresponding parts in the parent application, now U.S. Pat. No. 4,403,436, and will be described briefly herein.

FIGS. 3 and 4 show positions of the parts in which the gun can be fired. FIG. 4 shows the trigger having been pulled and one of the hammers starting to move towards its firing pin. The upper end 55 of the trigger extension 54 moves relative to the head 75 of the pin 74.

The parts of the trigger mechanism are carried by a frame 130 having a configuration as may be seen in the figures. In the actual trigger construction, in a double-barrelled gun, there are of course two hammers with related hammer springs and sears, as shown in detail in the prior application. The two hammers are on opposite sides of a web 131, one being designated at 132, associated with the firing pin 133. The trigger 52 is mounted in a slot 136. Both hammers are mounted on the same pivot stem 137, and the hammer 132 has a forwardly extending toe 138 and a rearwardly extending toe 139 with a notch 140 in it, which cooperates with an end of the sear 142 carried on a pivot member 143.

The hammer 132 on the rear side has a recess 146 in which is received one end of a hairpin spring 147, the other end of which engages a pin 148. The structure of the other hammer assembly for the other barrel is similar. Individual hammers, when released, as will be described, engage their respective firing pins.

Numeral 149 designates a trigger spring, one end of which is fastened to the base 130 by a screw as shown, and the other end as designated at 150 has a right-angle part which extends into a hole in the trigger 52 so as to normally bias the trigger in a clockwise direction.

The sear 142 has a toe 152 at its forward end which can engage in the notch 140 in the extending part 139 of the hammer 132. The sear 142 is normally biased in a clockwise direction by means of a leaf spring 156 which is secured to the underside of the sear by a screw as shown, the spring abutting a groove 157 in base 130, as shown.

The trigger cooperates with a connector block which in turn cooperates with the sears to accomplish the firing, as will be described. Either one of the two barrels can be selected for firing first. The connector block is identified as a whole by the numeral 160. It is bifurcated at the top, the trigger extension 54 extending between the bifurcations, the connector block being pivotally attached by a pivot pin 162. FIG. 3 shows the parts in a position ready for firing. The lower part of the connector block 160 is slotted, and received in the slot is a selector piece 164, which in turn is carried in a slot in the trigger 52. This piece can be moved laterally from one side to the other by means of a selector button 166, by means of which either one barrel or the other can be selected to be fired first. When the piece 164 moves to one side or the other, it tilts the connector block 160 from one side to the other so that it will engage either one sear or the other with the corresponding barrel to be fired first, as will be described.

The connector block 160 has a pair of laterally spaced catches, one of which is shown at 170, which can cooperate with the end tip 151 of the sear 142 for releasing the trigger 132. When the trigger is pulled in the position of FIG. 3, catch 170 raises the end tip 151 of the sear 142, releasing the hammer 132 which starts moving in a counterclockwise direction, as shown in FIG. 4. The toe 139 of the hammer 132 engages the end 152 of the sear 142 and rotates it in a counterclockwise direction. The connector block 160 has a cam surface 174 which is just over the catch 170. When the sear 142 is rotated in a counterclockwise direction, it engages the cam surface 174, causing the connector block 160 to be rotated in a counterclockwise direction about its pivot. The connector block 160 is normally biased in a clockwise direction by means of a biasing spring, not shown, but which is like that of the prior application, now U.S. Pat. No. 4,403,436 referred to. After the hammer 132 has moved against its firing pin, the sear 142 is rotated back in a clockwise direction by its biasing spring 156 to allow connector block 160 to come forward. The connector block 160 is then moved forwardly in a clockwise direction under the influence of its biasing spring.

The connector block 160 has a slot, that is, a transverse groove, in its side, as shown at 178, having a flat bottom. The other side of the connector block 160 has a similar groove. After one barrel or the other has fired and the connector block 160 has been moved rearwardly by its sear and then moved forwardly again, an opposite sear comes into position into one of the grooves, such as the groove 178, so that upon the next pull of the trigger, the other sear will be actuated by the connector block 160 and accordingly the other barrel fired. The two sears cooperate with the connector block 160 in the same manner.

It should be understood that the trigger mechanism as just described is like that of the previous application and is exemplary of other trigger mechanisms usable in firearms in which the invention can be adapted.

SUMMARY OF OPERATION

Summarizing the operation, FIGS. 1 and 2 illustrate the opening, closing, and locking of the breech. When closed and locked, the lever 22 is in mid position.

Figure 7:
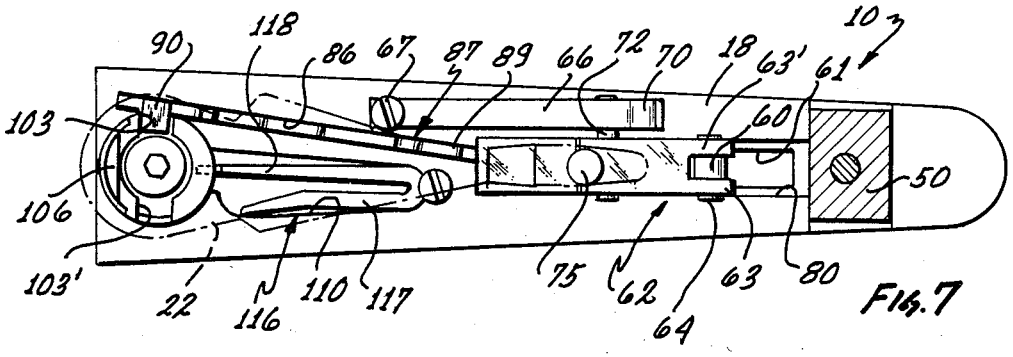
FIG. 7 is a view taken along the line 7—7 of FIG. 4 wherein the parts are in the firing position.

When the breech is closed and locked, lever 22 is in its mid position, and the parts are in the position as shown in FIGS. 3, 4 and 7. In this position of the parts, the pin 74 is in alignment with the recess 82 in the panel 18, and the firearm can be fired with the trigger extension 54 sliding underneath the head 75 of pin 74, as previously described.

Whenever the breech is open or in any position other than closed and locked with the lever 22 not in mid position, the parts are in positions as illustrated in FIGS. 5 and 6. In this position, pin 74 is out of the recess 82, and its end bears against the inner surface of panel 18. In this position, the head 75 of pin 74 engages the upper end 55 of trigger extension 54, preventing the trigger from being rotated in a counterclockwise direction so that the weapon cannot be fired. The weapon can only be fired when the parts are in a position as shown in FIGS. 3 and 4, with the end of pin 74 in alignment with the recess 82.

From the foregoing, those skilled in the art will readily understand the nature and construction of the invention and the manner in which all of the objects, as set forth in the foregoing, are realized. The invention provides a safety feature in that it is impossible to fire the weapon unless there is assurance that the breech is closed and locked.

The foregoing disclosure is representative of a preferred form of the invention and is to be interpreted in an illustrative rather than a limiting sense, the invention to be accorded the full scope of the claims appended hereto.

I claim:

1. In a firearm having a breech which can be opened and closed, the gun having a trigger means and having a safety mechanism including a trigger block which is positionalbe into a firing position into a safety position, the gun having lever means for unlocking and locking the breech in a closed position, the improvement comprising a linkage extending between said lever means and said trigger block whereby when the lever means is out of the closed and locked position of the breech, said trigger block is moved out of the said firing position and into a position wherein actuation of the trigger for firing is prevented, said trigger block having means movable to cooperate with a fixed part of the firearm to allow firing when said block is in said firing position.

2. A firearm as in claim 1 including means whereby the trigger block and trigger means are related in such a way that the trigger is blocked from actuation wherever the said trigger block is in a position other than the said firing position, the said block having only one single firing position.

3. A firearm as in claim 1 including a safety button connected to said trigger block for moving said trigger block between said firing position and a safety position.

4. A firearm as in claim 1 wherein the said trigger block includes means cooperable with the trigger means and having a construction whereby it has a single position which is said firing position, and in any position other than said firing position, the firearm is on safety with the trigger blocked.

5. A firearm as in claim 4 wherein said trigger block is movable relative to the trigger member, the trigger block including said movable means positionable by movement of the trigger block for releasing the trigger means for firing, the said means being actuatable in a single discrete position for releasing and actuatable for holding the trigger blocked in any position out of said movable single discrete position.

6. A firearm as in claim 5 wherein said movable means positionable by the said trigger block is in the form of a movable pin engageable with the trigger member, a fixed part having a recess positioned to receive the end of said pin, whereby when the pin is in a position to have its end received in the recess, the trigger means is released, and when the end of said pin is out of said recess, the trigger means is blocked.

7. In a firearm having a receiver and a breech, a safety member carried by the firearm, trigger means, block means actuatable by the safety member and cooperable with the trigger means to block the trigger means against actuation when the safety member is in a safe position, a movable member carried by the block means and cooperable with the trigger means to block operation of the trigger means, fixed means cooperable with the movable member providing a single discrete predetermined position wherein the movable member is allowed to move relative to the said block means, the movement of the said movable member in the said single position being sufficient to allow the trigger means to be actuated, the trigger means being blocked in any position of the movable member other than said predetermined position.

8. A firearm as in claim 7 wherein said movable member is in the form of a pin extending in a bore in the said block means, the fixed means having a recess positioned to have the end of the pin extend into it whereby the pin is moved along its axis when it is moved away from the said recess.

* * * * *

UNITED STATES PATENT AND TRADEMARK OFFICE

CERTIFICATE OF CORRECTION

PATENT NO. : 4,597,212

DATED : July 1, 1986

INVENTOR(S) : Fred Jennie

It is certified that error appears in the above-identified patent and that said Letters Patent are hereby corrected as shown below:

In claim 1, line 4, the word "positionalbe" is corrected to read --positionable--.

In claim 2, lines 3 and 4, the word "wherever" is corrected to read --whenever--.

Signed and Sealed this

Fourteenth Day of October, 1986

[SEAL]

*Attest:*

DONALD J. QUIGG

*Attesting Officer*

*Commissioner of Patents and Trademarks*